United States Patent [19]

Gorman

[11] 4,192,628

[45] Mar. 11, 1980

[54] FLOW DISTRIBUTOR FOR LEACHING FIELDS

[76] Inventor: Edward D. Gorman, Myra Rd., Box 18, R.R. #1, Porters Lake, Halifax County, Nova Scotia, Canada

[21] Appl. No.: 906,230

[22] Filed: May 12, 1978

[51] Int. Cl.[2] ..... E02B 13/00

[52] U.S. Cl. ..... 405/45; 405/46

[58] Field of Search ..... 405/36, 43, 46, 47, 405/48, 45

[56] References Cited

U.S. PATENT DOCUMENTS

| | | | |
|---|---|---|---|
| 1,078,637 | 11/1913 | Naylor | 405/43 |
| 2,366,522 | 1/1945 | Gutman | 405/46 |
| 2,803,948 | 8/1957 | Dorfman | 405/46 |
| 3,339,366 | 9/1967 | Gogan et al. | 405/36 |
| 3,645,100 | 2/1972 | La Monica | 405/46 |
| 3,820,341 | 6/1974 | Richard et al. | 405/46 |

*Primary Examiner*—David H. Corbin

*Attorney, Agent, or Firm*—Burns, Doane, Swecker & Mathis

[57] ABSTRACT

A distributor unit for use in leaching fields comprises a hollow open-bottomed concrete structure having a top wall and side and end walls defining a central cavity and which, in use, protects a sand bed into which effluent material from a septic tank can flow. The top of the structure is provided with a longitudinal channel which receives a perforated supply pipe for the effluent, and the base of the channel has apertures through which the effluent material can flow from the channel down onto the sand bed. The side walls have openings to allow evaporation of liquid from the central cavity. The whole structure is designed to be surrounded by crushed stone and to be covered with earth.

13 Claims, 3 Drawing Figures

FLOW DISTRIBUTOR FOR LEACHING FIELDS

The present invention relates to a flow distributor unit for distributing liquid onto a sub-surface absorption or leaching bed, and is particularly intended for distributing the effluent from a septic tank into such a bed.

Presently, it is common for the effluent from a septic tank to be passed into a length of perforated pipe which is laid under the soil on an absorption or leaching bed. With this simple arrangement a long length of pipe is required. Alternatively, a series of so-called "leaching chambers" may be used, these being usually in the form of hollow open-bottomed concrete units which are placed on a drainage bed to maintain an air space above the bed when the whole unit is covered with earth. The units have means for distributing effluent liquid onto the bed, and the units have side openings allowing lateral flow of liquid or vapor from the units. Prior art leaching chambers are shown for example in U.S. Pat. Nos. 3,339,366 to Gogan, 3,645,100 to La Monica and No. 3,820,341 to Richard et al.

The use of such leaching units allows for shorter pipe runs and less excavation than when simple perforated pipe is used, and qualifies smaller properties for a sewage system.

The structure shown in the La Monica patent, with which I am most familiar, has in the top wall an integral longitudinal bore having a spigot on one end and a socket on the other end so that a series of these units can be connected together with the longitudinal bores of the units providing a continuous pipeline for the supply of effluent to the units. The lower sides of the bores communicate with the cavities inside the units through slots. This construction has two drawbacks. Firstly, cleaning out the slots is a somewhat difficult operation since they are not easily accessible from the inspection-cleanout covers which are provided above the central portion of the bore. A person requiring to clean out the slots either has to put his arm along the urine saturated bore and use a tool within the outermost pair of slots which are spaced outwardly from the inspection covers, or requires a source of high pressure air or water. A second drawback is that in the case of any shifting or settling of the sand bed on which the units rest there occurs a break in the joint between adjacent units, that could render ineffective the units which are downstream of the break.

The structure shown in the Richard et al patent is somewhat similar in having a pipe in its upper central portion for supplying the effluent, although this pipe is not formed integrally with the structure. However, even if a plastic pipe were to be used in this situation, to avoid breakage problems, there would not appear to be any easy means for removal of the pipe for cleaning, nor for any cleaning of the pipe apertures in situ. In order to be removed, the pipe sections would seemingly have to be uncoupled and then somehow pulled through the whole length of the assembled units.

In the Gogan patent, it is proposed that the perforated supply pipe merely rests on the sand under the units, so that again removal of the pipe, or access for cleaning the pipe, would be quite difficult.

The present invention provides a leaching chamber unit which overcomes these drawbacks of the prior art.

In accordance with the present invention, a unit for distributing liquid onto an absorption bed comprises a hollow open-bottomed structure having a top wall and side and end walls defining a central cavity, and the top wall is provided with an upwardly opening longitudinal channel for receiving a perforated liquid supply pipe, the top wall having apertures allowing fluid to flow from the channel into the central cavity. The channel has a removable top, allowing direct vertical access to the whole length of the channel for lifting the pipe from the channel and also providing direct vertical access to the channel apertures for cleaning purposes.

The term "direct vertical access" in this context means that the apertures can be cleaned by a simple straight tool passing through the open top of the channel and into the apertures.

With this arrangement, the effluent can be supplied to the leaching chambers by a standard perforated plastic pipe which is not subject to any breakage due to shifting of the units. The pipe can easily be lifted vertically from the channel both for cleaning or renewal of the pipe, and to allow easy access to the apertures at the base of the channel.

The invention will be further described with reference to the accompanying drawings, showing a preferred embodiment of the leaching chamber of this invention, and in which.

Figure 1:
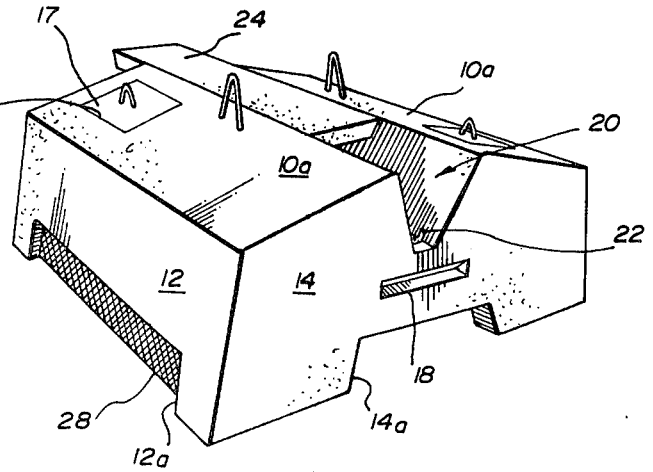
FIG. 1 is a perspective view of the leaching chamber as such.
Figure 2:
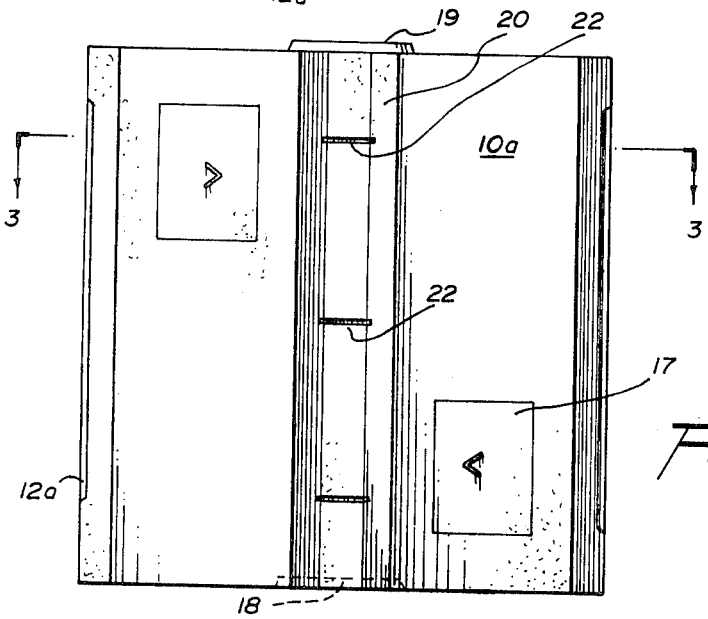
FIG. 2 is a top plan view of the leaching chamber with the cover for the channel removed.
Figure 3:
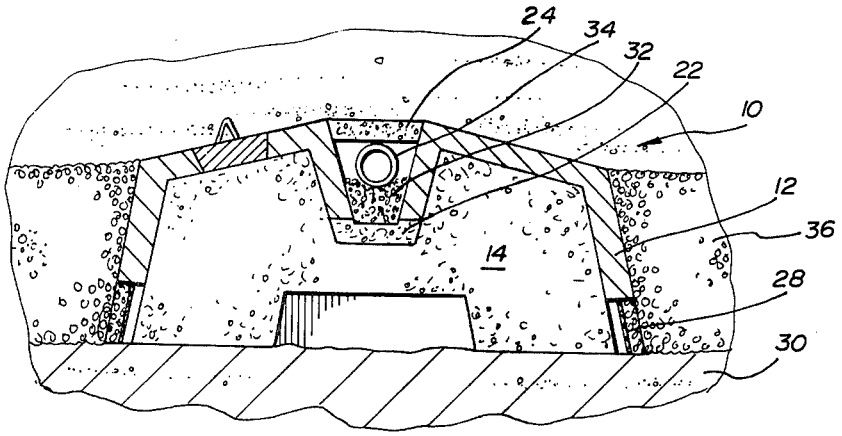
FIG. 3 is a cross-sectional view of the chamber on line 3—3 of FIG. 2, and showing the chamber installed in a field bed.

As best illustrated in FIGS. 1 and 3 the leaching chamber of this invention is an open-bottomed hollow concrete structure having a top wall 10, side walls 12 and end walls 14. The structure is reinforced with steel rods in conventional manner. The unit is typically about 4' (1.22 meters) square at the base and about 20" (51 cm) in overall height.

The top wall 10 has two side portions **10*a* which slope downwardly and outwardly from a central portion of the top so that the whole top is generally arched in shape. The side portions 10*a* have inspection openings 16 which are about 9" (23 cm) wide and 12" (30 cm) long, the sides of which converge downwardly to retain concrete inspection covers 17 which have similarly shaped sides. The central portion of the top is recessed to form a longitudinal upwardly opening channel 20** of uniform cross section and which extends the full length of the unit, the channel having sides which diverge upwardly from a horizontal base. The top of the channel is about 9" (23 cm) in width.

In the base of the channel is a series of three spaced apertures in the form of transverse slots 22 which extend through the thickness of the base of the channel and also extend slightly up the sides of the channel. The slots are each ⅜" (1 cm) wide at their top and diverge downwardly. These slots allow liquid within the channel to be distributed onto a sand bed on which the unit rests. The upwardly diverging side portions of the channels are suitable for locating and supporting the similarly sloping sides of a removable concrete cover 24 which extends the full length of the unit, this cover providing a substantially smooth top for the unit and protecting the interior of the channel.

The sides 12 of the unit have openings provided by recesses **12*a*, which are about 3' (1 meter) in length and 5" (13 cm) in height. The areas of these openings are each covered by a ½" (1.2 cm) metal screen mesh 28**.

The end walls 14 are provided with similar recesses 14*a*, 18" (45 cm) in length and about 5" (13 cm) in height, although these are not provided with any screen. The end walls also have a socket 18 at one end of the unit and a correspondingly placed spigot 19 at the other end. The socket 18 is horizontally elongated and of wedge shaped cross-section, and is designed to mate with the similarly shaped spigot 19 for aligning the units on installation and also for limiting movement between sections due to subsidence.

The structure and the covers are of course provided with suitable lifting loops as indicated in the drawings.

The manner of use of the leaching chamber of this invention is illustrated in FIG. 3.

Firstly, a trench 6' (1.8 meters) in width is excavated, and a 6" (15 cm) layer of sand 30 is placed on the bottom of the trench. Then a row of the leaching chamber units is arranged along the center of the trench, with the chambers end to end so that the openings 14*a* provide communication between adjacent units. Generally about 12 chambers may be used for the effluent from a septic tank which would otherwise require about 250 feet of simple perforated pipe. A layer 32 of crushed stone of about 3" (7.5 cm) depth is then placed in the central channel 20, and on this is laid a standard perforated pipe 34 of polyvinylchloride plastic. The crushed stone 32 can be arranged to give a final level adjustment of the pipe so that effluent can flow along the plastic pipe from one end of the row of units to the other. At the end of the flow run, both the pipe, and the trough formed by openings 14*a*, are capped to prevent flow of liquid past this end. The covers 24 are then put in place over the pipe. On each side of the row of units there is arranged a 16" (41 cm) high bed of 1" (2.5 cm) crushed stone 36, this being about 1' (30 cm) wide and allowing evaporation of liquid which passes laterally out of the units through the screens 28. Finally, the crushed stone and units are covered with the excavated soil. The units are sufficiently strong to stand the weight of vehicles on top of the replaced soil, and settling of the units will not rupture the pipe which can be adjusted in position within the channel 20 if necessary.

In use, the effluent flows along the pipe 34 leaving through the perforations in this pipe and percolating down through the crushed stone 32, and dripping through slots 22 onto the sand bed below the units. The liquid can pass as necessary from one unit to another through openings 14*a*, and the screen openings 28 allow the liquid to flow outwardly into the stones. Depending on conditions, the liquid may evaporate before passing out of opening 28, but in any case there will be evapotransporation of liquid from the bed under the unit. The screens 28 hold back the crushed stone upon installation, and although the screens will deteriorate after about a year the settled stone will not enter the unit to any appreciable extent after this time.

Every several years the units can easily be cleaned by scraping away the surface earth, lifting the covers 24 to expose the pipe 34 and removing the pipe by lifting this vertically from the channel, in a convenient and easy manner, removing the crushed stone 32 as necessary, and scraping of the slots 22 with a putty knife or like object. Cleaning is easy since there is direct access to all of the slots 22, unlike in the arrangement shown in the above-mentioned U.S. Pat. No. 3,645,100. Also, the inspection covers 17 can be lifted for raking or inspection of the sand.

If desired, due to lot requirements, several rows of the leaching units may be used in parallel.

I claim:

1. A unit for supporting a perforated liquid supply pipe above an absorption bed and for distributing liquid from said pipe onto said bed, comprising a hollow open-bottomed structure having a top wall and side and end walls defining a central cavity, and wherein said top wall is provided with an upwardly opening longitudinal channel extending along the full length of said top wall and suitable for receiving said supply pipe, said top wall having apertures allowing fluid to flow from said channel into the cavity, and wherein said channel has removable cover means extending along the full length of the top of the channel and allowing direct vertical access to the whole length of said channel for lifting of said pipe from the channel and for providing direct vertical access to said apertures for cleaning purposes.

2. A unit according to claim 1, wherein said channel has a base and sides which diverge upwardly from the base of the channel, said removable cover means being arranged to rest on the upper portions of said diverging sides.

3. A unit according to claim 1, wherein said apertures comprise transverse slots spaced along the base of the channel.

4. A unit according to any of claims 1–3, in which the top, side and end walls are integrally formed of concrete.

5. A unit according to any of claims 1–3, wherein said side walls have openings communicating with the central cavity.

6. A pre-cast concrete unit for supporting a perforated liquid supply pipe above an absorption bed and for distributing liquid from said pipe onto said bed, comprising a hollow open-bottomed structure having a top wall and side and end walls defining a central cavity, said side walls having openings to allow evaporation of liquid out of the cavity, and wherein said top wall has two side portions which slope downwardly and outwardly from a central portion which central portion is recessed to form a longitudinal upwardly opening channel extending the full length of said top wall and suitable for receiving said pipe, said channel having sides which diverge upwardly from its base, and said top wall having apertures at the base of said channel allowing fluid to flow therefrom into said cavity so that liquid can flow from said supply pipe and pass into the cavity, and further comprising removable cover means extending along the full length of the channel and arranged to close the top of said channel and allowing direct vertical access to the whole length of the channel for lifting of the pipe from the channel and for providing direct vertical access to the apertures for cleaning purposes.

7. A unit according to any of claims 1, 2 or 6, wherein said end walls have openings.

8. A unit according to any of claims 1, 2 or 6, wherein said top wall has an inspection opening formed on each side of said channel, said inspection openings permitting inspection of a bed covered by the unit and being normally closed by covers.

9. The unit of any of claims 1, 2 or 6, wherein said channel is capable of accommodating a 4" diameter liquid supply pipe in addition to a bed of crushed stone under said supply pipe of about 3" depth.

10. The unit according to any of claims 1, 2 or 6, wherein said side walls have recesses in the bases thereof constituting sidewall openings, the areas of said sidewall openings being covered by a metal screen.

11. A system for distributing liquid onto an absorption bed comprising a series of hollow open-bottomed structures each having a top wall and side end walls defining a central cavity, and wherein each said top wall is provided with an upwardly opening longitudinal channel extending along the full length of the top wall, the channels of said structures being aligned, said system further comprising a perforated pipe removably supported in said channels for supplying fluid to the channels, said top wall of each structure having apertures allowing fluid flow from said channel into the cavity, and wherein said channels each have removable cover means allowing direct vertical access to the whole length of said channel to allow lifting of said pipe from the channel and for providing direct vertical access to said apertures for cleaning purposes.

12. A system according to claim 11, wherein each said channel has a base and sides which diverge upwardly from the base of the channel, said removable cover means being arranged to rest on the upper portions of said diverging sides.

13. A system according to claim 11 wherein said perforated pipe is supported in the channel of each structure by a layer of crushed stone.

* * * * *